US008056502B2

(12) United States Patent
Takeuchi

(10) Patent No.: US 8,056,502 B2
(45) Date of Patent: Nov. 15, 2011

(54) FILM FORMING EQUIPMENT

(75) Inventor: Tohru Takeuchi, Hiratsuka (JP)

(73) Assignee: Kansai Paint Co., Ltd., Hyogo (JP)

( * ) Notice: Subject to any disclaimer, the term of this patent is extended or adjusted under 35 U.S.C. 154(b) by 606 days.

(21) Appl. No.: 11/885,441

(22) PCT Filed: Mar. 14, 2006

(86) PCT No.: PCT/JP2006/305472

§ 371 (c)(1),
(2), (4) Date: Aug. 31, 2007

(87) PCT Pub. No.: WO2006/103964

PCT Pub. Date: Oct. 5, 2006

(65) Prior Publication Data

US 2008/0190362 A1 Aug. 14, 2008

(30) Foreign Application Priority Data

Mar. 29, 2005 (JP) ..... 2005-093791

(51) Int. Cl.
*B05B 13/02* (2006.01)
*B05B 3/00* (2006.01)
*B05C 11/00* (2006.01)

(52) U.S. Cl. ..... 118/686; 118/687; 118/679; 118/324; 118/323

(58) Field of Classification Search ..... 118/324, 118/686, 671–681, 321, 323, 687; 427/424, 427/427.1–427.3

See application file for complete search history.

(56) References Cited

U.S. PATENT DOCUMENTS 3,378,394 A 4/1968 David
5,067,436 A * 11/1991 Matsushima et al. ..... 118/676

FOREIGN PATENT DOCUMENTS

JP A-02-035965 2/1990
JP A-05-146725 6/1993

OTHER PUBLICATIONS

Supplementary European Search Report issued from the European Patent Office on Jun. 3, 2009 in the corresponding European patent application No. 06715700.8.

* cited by examiner

*Primary Examiner* — Yewebdar Tadesse
(74) *Attorney, Agent, or Firm* — Posz Law Group, PLC

(57) ABSTRACT

The present invention provides film forming equipment that can reduce the space necessary for coating. The film forming equipment has an object conveyor for moving an object (50); a spray gun conveyor (41) for moving a spray gun (30) that sprays a coating material; and a controller for controlling operations of the object conveyor (41), the spray gun (30), and the spray gun conveyor, wherein the controller moves the object (50) in a specific direction while spraying a coating material from the spray gun (30) and reciprocates the object (50) so that partial layer coating can be sequentially conducted, and while coating the object (50), the controller shifts the object (50) and the spray gun (30) while keeping the relative positions of the object and the spray gun to each other constant.

5 Claims, 7 Drawing Sheets

1
10
41
40
43
42
50
22
30

Gun Conveyor
Spray Gun
Object Conveyor
Controller
Temperature Sensor
Humidity Sensor
Air Cond. System
13
30
41
12
14
15
10

1
10
15
X
X
21
20
24
22
30
44
50
25
23

22a
31
22
50
S

22a
T
31
50
22
S 22a
50
22
31
S 22a
22
50
31
S 22
50
22a
31
S 50
31
I
H 50
31
S 50
31
J

50

50
31

50
31
S 31
50
S 50
31

FILM FORMING EQUIPMENT

TECHNICAL FIELD

The present invention relates to film forming equipment.

BACKGROUND ART

In order to apply a coating of a uniform thickness to an object, a coating method has been conventionally employed using a spray pattern formed by a coating material sprayed from a spray gun. Layer coating is conducted using film forming equipment comprising an air conditioner, a spray gun, etc., in a manner as shown in, for example, FIG. 7. In other words, a spray pattern 153 is formed by spraying a coating material from a spray gun that is fixed in the center of a coating booth 151, and moving an object 152, which is placed beneath the spray gun, by using an object conveyor (not shown) up and down at a predetermined speed, while shifting the object in the direction shown by the arrow S (i.e., from left to right in the figure) at a predetermined distance.

It is also possible to conduct layer coating by forming the spray pattern 153 by spraying a coating material from the spray gun to an object 152 fixed in the center of the coating booth 151, as shown in FIG. 8, using a spray gun that is disposed above the object 152, and moving the spray gun up and down at a predetermined speed while shifting it in the direction shown by the arrow S (i.e., from left to right in the figure) at a predetermined distance.

DISCLOSURE OF THE INVENTION

Problem to be Solved by the Invention

When layer coating is conducted while fixing the spray gun and moving the object, as described above, the layer coating must be started when the object is at a position apart from the spray pattern and continued until the object has completely passed through the spray pattern. In other words, an unduly large space, i.e., (length of the object×2+width of the spray pattern)×(width of the object×2+width of the spray pattern), is necessary for coating.

Similarly, when the layer coating is conducted while fixing the object and moving the spray gun, the layer coating must be started when the spray pattern is at a position apart from the object and continued until the spray pattern has completely passed through the object. In other words, an unduly large space, i.e., (length of the object+width of the spray pattern×2)×(width of the object+width of the spray pattern×2), is necessary for coating. Furthermore, when coating is conducted in such a manner, extra space should be provided between the inner surface of the coating booth and the spray pattern in order to prevent the spray pattern from soiling the coating booth, requiring an even larger space.

The need for such an unduly large space for coating restricts the places in which the film forming equipment can be installed, and much energy is required to regulate the air in the coating booth.

The present invention has been accomplished in order to solve such problems, and provides film forming equipment that can reduce the space necessary for coating.

Means for Solving the Problem

The object of the present invention can be achieved by film forming equipment comprising an object conveyor for moving an object; a spray gun conveyor for moving a spray gun that sprays a coating material; and a controller for controlling operations of the object conveyor, the spray gun, and the spray gun conveyor, wherein the controller moves the object in a specific direction while spraying a coating material from the spray gun and reciprocates the object so that partial layer coating can be sequentially conducted, and while coating the object, the controller shifts the object and the spray gun while keeping the positions of the object and the spray gun relative to each other constant.

In this film forming equipment, it is preferable that the direction in which the object and the spray gun are shifted be opposite to the direction in which the object subjected to partial layer coating moves.

It is also preferable that the shifts of the object and the spray gun be conducted when the center of spray emitted from the spray gun is positioned substantially in the longitudinal middle of the object in the shifting direction.

It is also preferable that the controller reciprocate the spray gun in a synchronized manner in the direction opposite to the reciprocation direction of the object.

EFFECT OF THE INVENTION

The present invention provides film forming equipment that can reduce the space necessary for coating.

EXPLANATION OF NUMERICAL SYMBOLS

Figure 2:
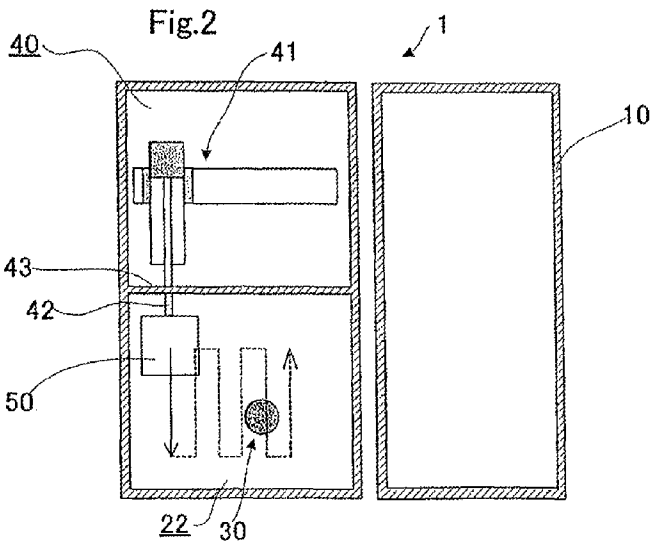
FIG. 2 is a sectional view taken along the line X-X in FIG. 1.

1 equipment for forming coating films
10 air conditioning system
15 piping
20 coating equipment main body
21 air supply chamber
22 coating booth
23 exhaust chamber
24 air supply filter
25 dust-collecting filter
30 spray gun
40 storage member
41 object conveyor
42 fixing jig
50 object

BEST MODE FOR CARRYING OUT THE INVENTION

Figure 1A:
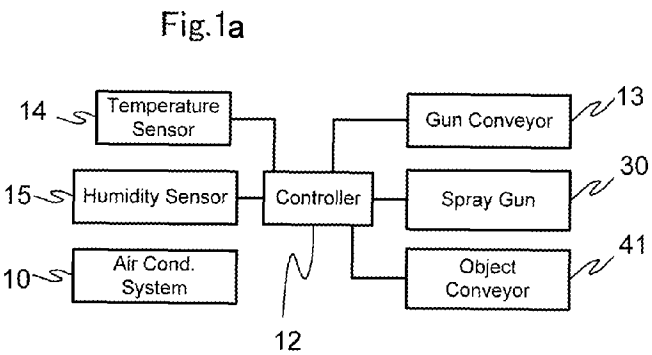
FIG. 1*a* shows a block diagram of the controller and parts connected to the controller.
Figure 1:
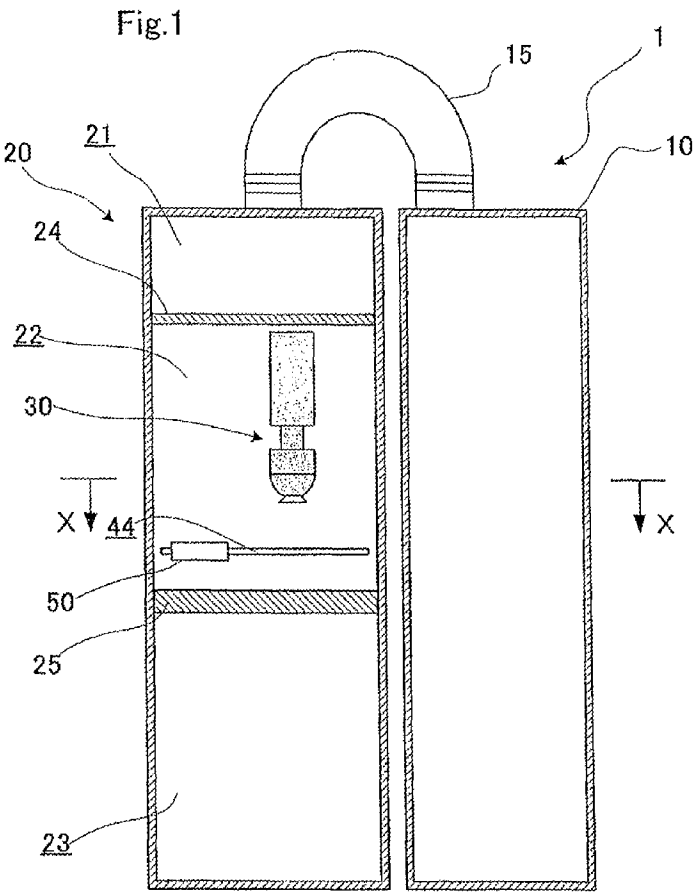
FIG. 1 shows equipment for forming coating films according to one embodiment of the present invention.

Equipment for forming coating films of the present invention is explained below with reference to the attached drawings. FIG. 1 is a cross-sectional view schematically showing the structure of equipment for forming coating films according to one embodiment of the present invention, and FIG. 2 is a plan-sectional view taken along the line X-X in FIG. 1.

As shown in FIG. 1, the film forming equipment 1 comprises an air conditioning system 10, piping 15, a coating equipment main body 20, a conveyor storage member 40, and a controller 12. The air conditioning system 10 supplies air whose temperature and humidity is conditioned to the coating equipment main body 20, such that the air conditioning system 10 communicates with the coating equipment main body 20 at the top portions thereof via the piping 15.

The coating equipment main body 20 is divided from the top to downward into an air supply chamber 21, a coating booth 22, and an exhaust chamber 23, such that the air supply chamber 21 and the coating booth 22 are partitioned from each other by an air supply filter 24, and the coating booth 22 and the exhaust chamber 23 are partitioned from each other by a dust-collecting filter 25.

The air supply chamber 21 comprises a temperature detector and a humidity detector (not shown) for detecting the temperature and humidity of the air supply chamber 21. Examples of temperature detectors are temperature sensors such as thermisters and thermocouples. Humidity sensors such as high polymer film humidity sensors, ceramic humidity sensors, and electrolyte humidity sensors can be used as humidity detectors.

The coating booth 22 comprises a spray gun 30 which functions as a coating material atomizer. A spray gun conveyor, coating material supplier, air control panel, high-voltage generator, cables, etc. (not shown) are connected to the spray gun 30. The spray gun 30 is structured so that its distance from the object 50 can be varied.

Rotational bell-type atomization coating devices, air-atomizing type coating devices, etc., may be used as the spray gun 30. A rotational bell-type atomization coating device comprises a bellcup that rotates at high speed on top of a coating gun, and the coating material discharged through the bellcup is atomized by centrifugal force generated by rotation of the bellcup. A rotational bell-type atomization coating device comprises an air nozzle for emitting shaping air that controls the width of the spray pattern of the coating material by regulating the scattering direction of the atomized particles of the coating material which scatter from the peripheral edge of the bellcup in the radially outward direction. An air-atomizing type coating device comprises nozzles around a coating material outlet for jetting out compressed air (atomized air), and atomizes a coating material by discharging the coating material from the discharge outlet while jetting compressed air from the nozzles. An air-atomizing type coating device usually comprises pattern air nozzles at the periphery of the compressed air nozzles so as to control the width of the spray pattern.

The spray gun conveyor 13 is a device that moves the spray gun 30 by receiving commands from the controller described later. Air cylinders, biaxial actuators, etc., are examples of spray gun conveyors. An example of a coating material supplier is a syringe pump wherein a coating material is supplied by a microactuator pressing the piston of a syringe filled with a specific amount of coating material. An air control panel controls the air pressure for rotating the bell, the flow rate of shaping air, and other conditions of the rotational bell-type atomization coating device. A high-voltage generator applies atomized particles which have been made into fine particles by an atomizer to an object 50 using static electricity.

The exhaust chamber 23 comprises an exhauster (not shown) for discharging the air supplied by the air conditioning system 10.

As shown in the sectional view of FIG. 2, a storage member 40 is disposed adjacent to the coating booth 22, and comprises a conveyor 41 for conveying the object 50. A spacer 44 of specific dimensions is formed beneath a partition 43 that separates the storage member 40 from the coating booth 22. The conveyor 41 comprises a fixing jig 42 for affixing the object 50 in the coating booth 22 via the spacer 44. A uniaxial actuator, biaxial actuator, etc., may be used as the conveyor 41 as long as the conveyor 41 can freely transport the object 50 over one surface in the coating booth 22. In the present embodiment, a biaxial actuator is used as the conveyor 41.

The controller 12 is connected to the air conditioning system 10, temperature sensor 14, humidity sensor 15, spray gun 30, spray gun conveyor 13, and object conveyor 41, etc., and controls the operations thereof.

A method for forming a coated film on the object 50 using the film forming equipment 1 of the present embodiment is explained below.

Initially, a predetermined amount of coating material is supplied to the coating material supplier provided with the spray gun 30. An object 50 is then affixed to the conveying jig 42 provided with the conveyor 41 in the coating booth 22. The air conditioning system 10, temperature sensor, humidity sensor, spray gun 30, object conveyor 41, spray gun conveyor, exhauster and controller are operated by turning on the film forming equipment 1.

The air conditioning system 10 supplies air to the air supply chamber 21 via piping 15. While feed backing the signals output from the temperature and humidity sensors provided in the air supply chamber 21, the controller regulates the temperature and humidity of the air supplied from the air conditioning system 10 to be substantially constant. The air whose temperature and humidity has been conditioned is fed to the coating booth 22 via an air supply filter 24.

A coated film is formed by reciprocating the object 50 while spraying a coating material from the spray gun 30 under conditions wherein the temperature and humidity in the coating booth are regulated, and moving the object 50 in a specific direction so that partial layer coating is conducted sequentially, forming a coated film on the object 50. The methods and operations for controlling the object 50 and the spray gun 30 during forming a coated film are described later.

Excess atomized particles of coating material which do not deposit on the object 50 are carried by the air flow supplied from the air conditioning system 10 and sent toward the exhaust chamber 23. In this process, atomized particles of coating material are removed by a dust-collecting filter 25. The air passing through the dust-collecting filter 25 is sent to the exhaust chamber 23, and then discharged via an exhauster.

Figures 3A, 3B, 3C, 3D, 3E:
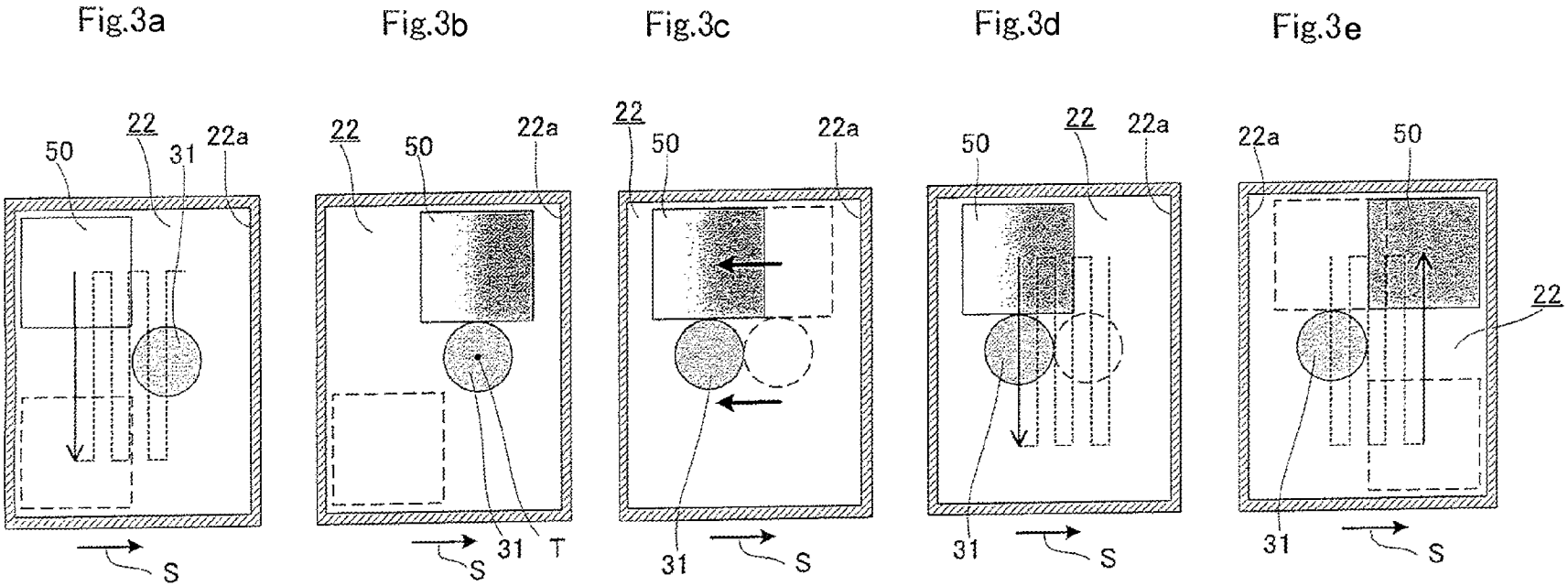
FIGS. 3*a*-3*e* show cross-sectional views of principal parts for explaining movement of the object and the spray gun.

Methods for controlling the object 50 and the spray gun 30 and operations thereof are explained below with reference to the sectional views of the principal parts of coating booth 22 shown in FIGS. 3*a*-3*e*. When coating is started, the controller regulates a spray gun (not shown) and the object 50 to be disposed so that the spray pattern 31 sprayed from the spray gun and the object 50 are apart from each other as shown in FIG. 3*a*. While spraying the coating material from the spray gun, an object conveyor (not shown) is operated so that the object 50 is moved up and down and shifted in the direction shown by the arrow S to sequentially conduct partial layer coating. In the present embodiment, the controller shifts the object 50 in the direction shown by the arrow S a predetermined distance at completion of each half of the round-trip, thus coating layers onto the object 50.

Secondly, as shown in FIGS. 3*b* and 3*c*, during the coating of the object 50, the object 50 and the spray gun are shifted in a predetermined direction while maintaining the specific relative position of the object 50 to the spray gun. In this embodiment, the shifting direction is opposite to that (the direction shown by the arrow S) when partial layer coating is sequentially conducted on the object 50. Shifting the object 50 in this direction reduces the space necessary for coating.

The timing for shifting is set so that the object 50 is shifted when the center of the spray pattern 31 (corresponding to the center of the spray emitted from the spray gun) is positioned substantially in the longitudinal middle of the object 50, in order to sequentially conduct partial coating in the shifting direction for the object 50 (the direction shown by the arrow S). By shifting the object at such a time, enough space is secured to prevent the spray pattern 31 from soiling the inner surface 22*a* of the coating booth 22, while reducing the space necessary for coating. The timing for shifting may be when the object 50 is traveling in the direction shown by the arrow S, or the object 50 is reciprocating.

The shifting amount of the object 50 and the spray gun is set so that the spray pattern 31 of the coating material emitted from the spray gun does not soil the inner surface of the coating booth.

Thereafter, as shown in FIG. 3*d*, while reciprocating the object 50, the object 50 is shifted in the direction shown by the arrow S a predetermined distance at completion of each half of the round-trip, thereby conducting layer coating on the object 50. When the object 50 has completely passed through the spray pattern 31 as shown in FIG. 3*e*, coating is completed.

As described above, the film forming equipment 1 of the present embodiment is structured so that the object 50 and the spray gun can be shifted during coating of the object 50 while keeping the relative position of the object 50 and the spray gun constant, and therefore it is possible to reduce the space necessary for coating and to prevent misalignment of the layer coating on the object 50.

Furthermore, due to the reduction of the space necessary for coating, the coating booth 22 can be miniaturized. This reduces the energy necessary for keeping the temperature and humidity in the coating booth 22 constant.

Because the temperature and humidity in the coating booth 22 can be kept constant with reduced energy, a compact air conditioner 10 with a low air-conditioning capability can be used. This achieves further miniaturization of the film forming equipment 1 and reduction of the facility's cost.

Miniaturization of the coating booth 22 also miniaturizes the film forming equipment 1 as a whole, and therefore this enhances the operational efficiency of installation of the film forming equipment 1, and eases constraints in the places in which the film forming equipment can be installed.

The shifting amount of the spray gun is set in a range that the spray pattern 31 of the coating material sprayed from the spray gun does not soil the inner surface 22*a* of the coating booth 22. Therefore, there is no risk of the coating material adhering to the inner surface 22*a*, and cleaning or other maintenance steps can be reduced, enhancing the efficiency of the coating process.

One embodiment of the present invention is explained above; however, the scope of the present invention is not limited to this. For example, it is also possible to control the operation of the spray gun conveyor so that the spray gun 30 is reciprocated in a synchronized manner in the direction opposite to that of the object 50. The operations of the object 50 and the spray gun 30 when such a control method is employed are explained below with reference to FIGS. 4*a*-4*h*.

Figures 4A, 4B, 4C, 4D, 4E, 4F, 4G, 4H:
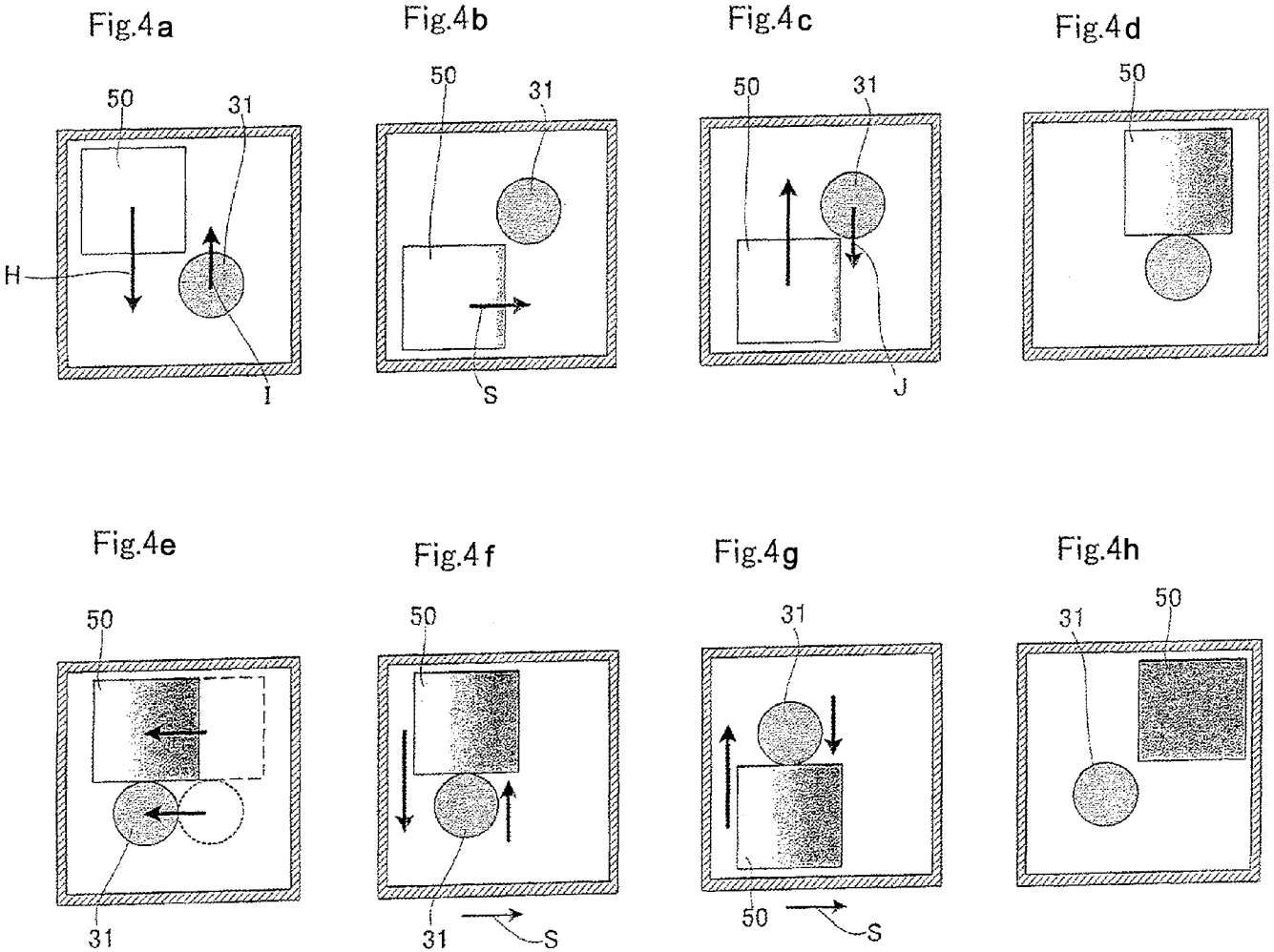
FIGS. 4*a*-4*h* show cross-sectional views of principal parts for explaining operation of the film forming equipment of another embodiment of the present invention.

When coating is started, as shown in FIG. 4*a*, the controller regulates the object 50 and the spray gun so as to be in positions such that the spray pattern 31 sprayed from the spray gun and the object 50 are apart from each other. While spraying the coating material from the spray gun, an object conveyor (not shown) is operated, the object 50 is shifted in the direction shown by the arrow H, and the spray gun conveyor is operated to shift the spray gun so that the spray pattern 31 is shifted in the direction opposite to the direction as shown by the arrow H (i.e., in the direction as shown by the arrow I).

The operations of the object conveyor and the spray gun are regulated so that when the first half of the round-trip of the object 50 is completed, the first half of the round-trip of the spray gun is also completed, and, as shown in FIG. 4*b*, the object conveyor and the spray gun are in positions where the coating material in the spray pattern 31 is not applied to the object 50. The object 50 is then shifted in the direction shown by the arrow S a predetermined distance. As shown in FIG. 4*c*, the object 50 is moved in a second half of a round-trip, the spray gun is also moved in a second half of a round-trip, and the spray pattern 31 is shifted in the direction shown by the arrow J. Coating proceeds by repeating such operations. By making the relative speed of the spray gun and the object 50 with respect to each other constant, a coated film having a uniform thickness can be formed.

As shown in FIGS. 4*d* and 4*e*, the object 50 and the spray gun are shifted in the predetermined direction (i.e., in the direction opposite to the arrow S) during coating the object 50, while keeping the relative position of the object 50 to the spray gun constant.

Thereafter, as shown in FIGS. 4*f* and 4*g*, while reciprocating the object 50 and the spray gun in directions opposite to each other in a synchronized manner, the object 50 is sequentially shifted in the direction as shown by the arrow S a predetermined distance every time the first half of the round-trip and the second half of the round-trip of the object 50 is completed and layer coating of the coating material is continued. Coating is completed when the reciprocating object 50 has completely passed through the spray pattern 31 as shown in FIG. 4*h*.

By conducting coating while reciprocating the object 50 and the spray gun in directions opposite to each other in a synchronized manner as described above, the distance between the positions at the start and completion of the reciprocation of the object 50 can be reduced. This further reduces the space necessary for coating in the direction of reciprocation of the object 50.

In the present embodiment, the shifting direction of the object 50 and the spray gun 30 is opposite the direction shown by the arrow S; however, the direction is not limited to this as long as the space necessary for coating can be reduced.

In the present embodiment, shifts of the object 50 and the spray gun 30 are conducted when the center of the spray pattern 31 sprayed from the spray gun 30 is at substantially the longitudinal middle of the object 50 in the direction shown by the arrow S; however, the timing for the shift is not limited to this.

In the present embodiment, as shown in FIG. 3 (*c*), the controller controls operations of the object conveyor and the spray gun conveyor so that the object 50 and the spray gun 30 shift once; however, the number of shiftings is not limited to one, and the operations may be such that the object 50 and the spray gun 30 are shifted a plurality of times.

Furthermore, in the present embodiment, the controller controls the operation of the object 50 so that the object 50 is sequentially shifted in the direction shown by the arrow S at the completion of each half of the round-trip of the object 50 as shown in FIG. 3 a predetermined distance. However, it is also possible to control so that the object 50 is shifted in the direction shown by the arrow S at a specific constant speed while reciprocating the object 50.

In the film forming equipment 1 of the present embodiment, it is possible to efficiently form a coated film having substantially the same quality as that coated under the coating conditions of an actual coating step by controlling the particle diameter, concentration and velocity of atomized particles in the spray pattern of coating material sprayed from the spray gun 30, and the relative shift of the spray gun 30 to the object 50.

A method for controlling the particle diameter, concentration and velocity of atomized particles in the spray pattern of coating material sprayed from the spray gun 30 is explained below. The atomized particle diameter is the average particle diameter of the particle swarm of atomized particles of coating material which have been atomized by a spray gun 30 measured at the point of reaching the object 50. The particle diameter can be measured by a laser diffraction particle size analyzer, etc. The atomized particle concentration is the total volume of particles passing through a unit area of the spray pattern. As a simplified method, the atomized particle concentration may be taken to be an average atomized particle concentration calculated from the flow rate of the coating material divided by the area of the sprayed pattern. The pattern area can be easily obtained by spraying the spray pattern onto a plate, etc. The atomized particle velocity is an average particle velocity of the particle swarm in the object 50 direction at the points the atomized particles reach the object 50. The atomized particle velocity can be measured by, for example, a laser Doppler velocimeter, etc.

When a rotational bell-type atomization coating device is used as a spray gun 30, the particle diameter can be easily set by suitably selecting the bellcup diameter of the rotational bell-type atomization coating device, the rotational speed of the bell, and flow rate of the coating material, etc., so that the particle diameter is substantially the same as that in the actual coating operation. The rotational speed of the bell can be controlled, for example, by varying the air pressure for rotating the bell of the rotational bell-type atomization coating device 30. The flow rate of the coating material can be controlled by varying the flow rate of the coating material supplier. Usually, a rotational bell-type atomization coating device used in an actual coating operation has a bellcup diameter of about 60 mmϕ to 70 mmϕ, its rotational rate is 20000-30000 rpm, and flow rate is 200 to 300 $cm^3$/min; however, when a small bellcup is used in the present embodiment, a particle diameter substantially the same as that in the actual coating operation can be obtained at a flow rate as small as about 20 to 30 $cm^3$/min and a rotational rate of about 10000 rpm.

When an air-atomizing type coating equipment is used as the spray gun 30, the particle diameter can be easily set so as to be substantially the same as that in the actual coating operation by suitably selecting the atomized air flow rate, flow rate of the coating material, etc. The atomized air flow rate can be controlled by reducing the volume of discharged air, etc.

The atomized particle concentration can be easily calculated based on the flow rate of the coating material relative to the pattern area formed on the object 50 by the spray pattern sprayed from the spray gun 30. Therefore, an atomized particle concentration that is substantially the same as that in the actual coating operation can be easily obtained by controlling the flow rate of the coating material. For example, when the width of the coating pattern in an actual operation is to be 30 cm and the flow rate is to be 200 $cm^3$/min, if the width of the coating pattern in the present embodiment is set at 10 cm, the ratio of pattern area of the present embodiment/the actual operation is 1/9. Therefore, the same atomized particle concentration can be obtained by setting the flow rate at 22.2 $cm^3$/min (200×(1/9)). Note that the width of the spray pattern can be easily changed by controlling the angle of the shaping air emitted from the rotational bell-type atomization coating device, and the flow rate thereof.

When a rotational bell-type atomization coating device is used as the spray gun 30, the atomized particle velocity can be easily made substantially the same as that in the actual coating operation by suitably selecting the flow rate of shaping air of the rotational bell-type atomization coating device, the coating distance, etc. Note that when air-atomizing type coating equipment is used as the spray gun 30, by suitably selecting the atomized air flow rate and the coating distance, the atomized particle velocity can be easily made substantially the same as that in the actual coating operation.

As described above, by controlling the flow rate of the coating material of the spray gun 30, coating distance, etc., it is possible to make the atomizing conditions of the coating material (particle diameter, concentration, and velocity of the atomized particles) substantially the same as those of the coating material deposited on an object 50 in an actual coating operation.

A method for controlling the relative movement of the spray gun 30 and the object 50 is explained below. Specifically, the relative movement of the spray gun 30 and the object 50 is controlled based on a coated film formation profile in an actual coating operation determined by the relationship between changes in the coated film formation time and the thickness of the resulting coated film.

Figure 5:
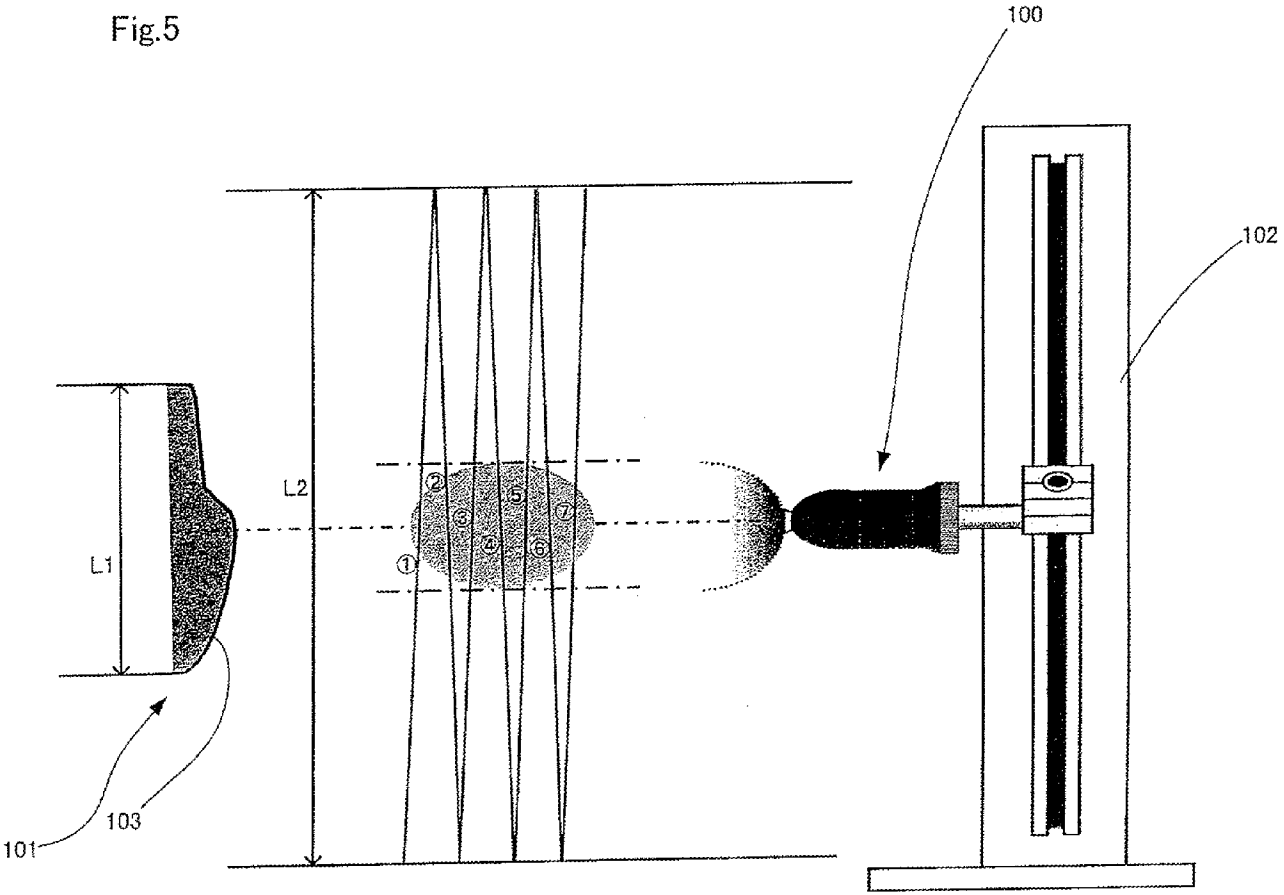
FIG. 5 is an explanatory drawing showing the path of coating equipment over an object to be coated in an actual coating step.
Figure 6:
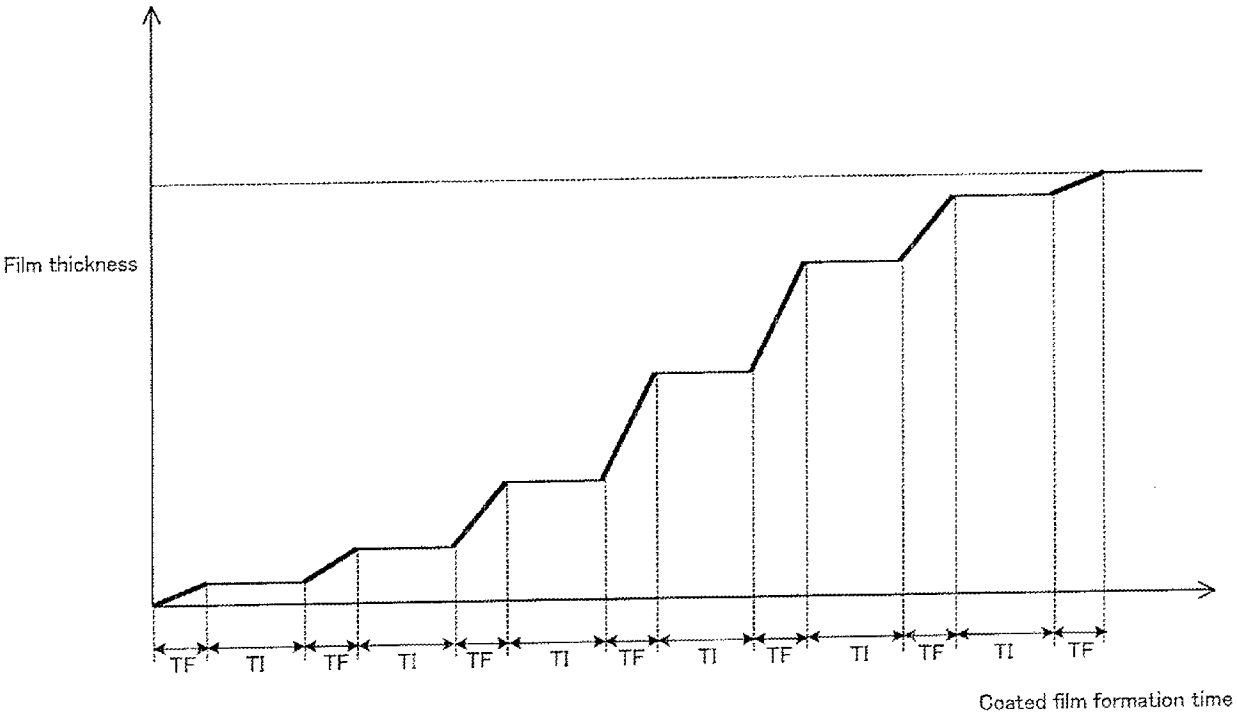
FIG. 6 is an explanatory drawing of a coated film formation profile in an actual coating step.
Figure 7:
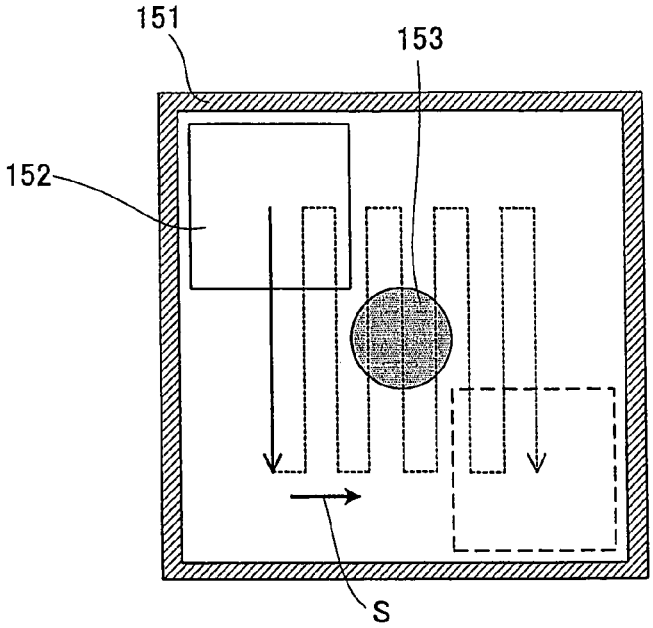
Fig.7 Prior Art
FIG. 7 is a drawing explaining a coating method in which conventional film forming equipment is used.
Figure 8:
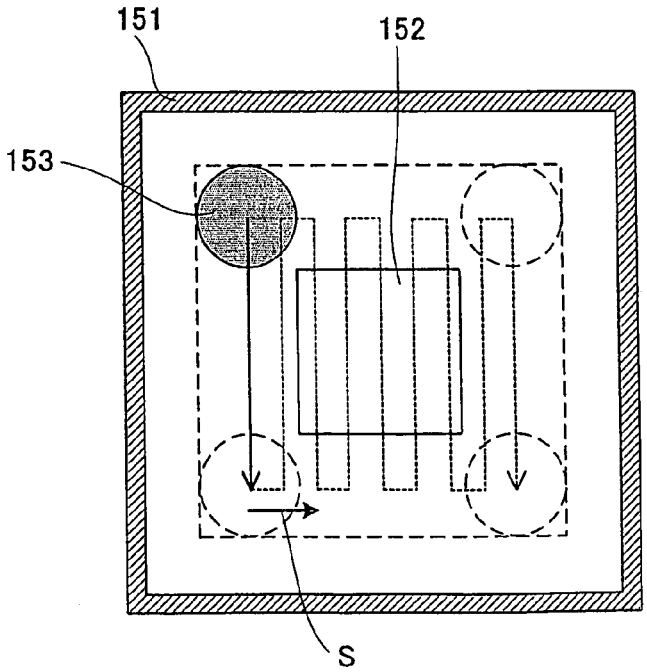
Fig.8 Prior Art
FIG. 8 is a drawing explaining a coating method in which another conventional film forming equipment is used.

The coated film formation profile in an actual coating operation is explained below with reference to FIGS. 5 and 6. FIG. 5 is an explanatory drawing showing the path of the spray gun 100 over a micro-area portion 103 of an object 101 in an actual coating step. FIG. 6 is an explanatory drawing illustrating the relation between the elapse time and the thickness of the coated film in the micro-area portion 103.

In FIG. 5, the spray gun 100 is attached to a vertical reciprocating member 102, and a coating material is sprayed to the object to be coated. In this embodiment, the spray gun 100 passes over the micro-area portion 103 of the coated object 101 seven times, so that a spray pattern is coated seven times, forming a coated film.

The floating time (TF) of the atomized particles as the spray gun 100 passes the micro-area portion 103 a single time can be calculated by dividing the passing length of the micro-area portion 103 L1 by the reciprocating speed. The spray gun 100 is also reciprocated in those portions other than the micro-area portion 103. The duration of the time in which the rotational bell-type atomization coating device 100 passes those portions other than the micro-area portion 103, i.e., the interval TI after the completion of a coating pass in the micro-area portion 103 to the subsequent coating pass, can be calculated by the expression TI=(Reciprocating width L2−Passing distance of the micro-area portion 103 L1)/Reciprocating speed. Therefore, a coated film formation profile as shown in FIG. 6 can be obtained with the horizontal axis indicating coated film formation time and the vertical axis indicating coated film thickness. The thickness of the coated film can be measured by an electro-magnetic coating thickness meter, laser displacement meter, etc. In FIG. 6, the film thickness is schematically shown by a straight line, but films deposit based on a logistic function in an actual coating operation.

The controller regulates the object conveyor 41 so as to produce a coated film formation profile determined by the relationship between changes in the coated film formation time and the thickness of the resulting coated film. In other words, the object conveyor 41 is controlled depending on the duration of the object 50's passings, number of times the object 50 passes, and the interval TI between the completion of one coating pass and the start of the subsequent coating pass in the spray pattern of the coating material sprayed from the spray gun 30 so that these agree with those of the coated film formation profile in an actual coating operation. Note that the object conveyor 41 is controlled so that the atomized particles of coating material do not deposit on the object 50 during the interval TI by having the object 50 stand still in or by moving the object 50 to a region in the coating booth where the atomized particles of coating material do not deposit.

This allows the deposition of the atomized particles of the coating material sprayed from the spray gun 30 on the object 50 (film deposition behavior) to be made substantially the same as in an actual coating.

Figure 9:
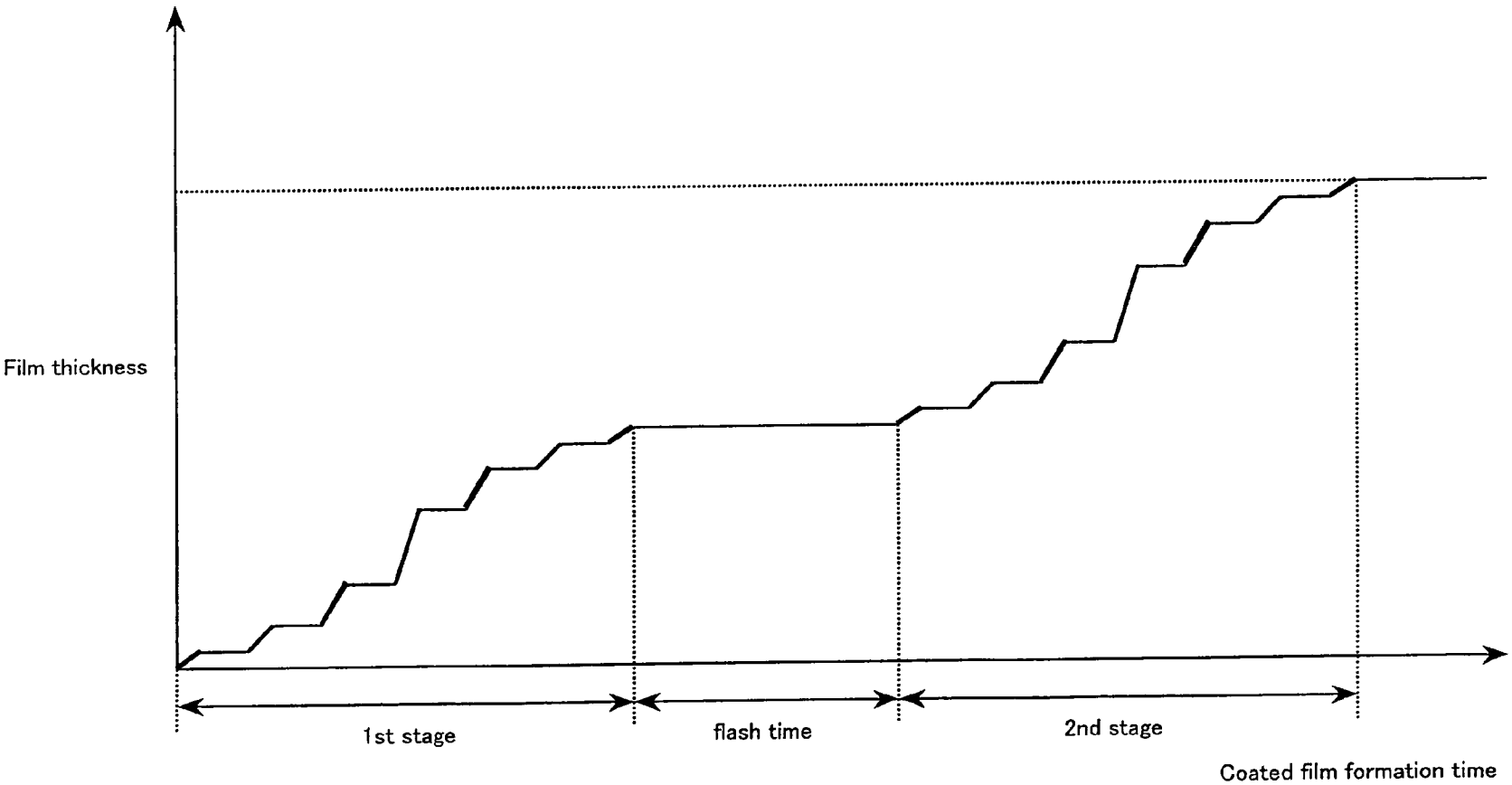
FIG. 9 is a drawing explaining another coated film formation profile in an actual coating step.

When the actual coating operation is to be conducted by 2-stage coating, i.e., the object is overcoated after previously conducting coating, as shown in the coated film formation profile of FIG. 9, flash time wherein no coating is conducted is provided between the completion of coating in the first stage and the start of coating in the second stage. When coating in the actual coating operation is to be conducted by two sets of coating with one flash time, by suitably setting the interval T1 so as to correspond to the timing of the flash time, the deposition (deposition behavior) of atomized particles of the coating material sprayed from rotational bell-type atomization coating device 30 on the object 50 can be made substantially the same as in the actual coating operation.

In multi-stage coating wherein the object is coated with a coating material three or more times, it is possible to make the deposition behavior substantially the same as in the actual coating operation by suitably setting the intervals T1 in such a manner that they correspond to the plurality of flash times.

As described above, the film forming equipment 1 of the present embodiment can reproduce coating conditions in an actual coating operation by controlling the temperature and humidity of the air in the coating booth 22, controlling the particle diameter, concentration, and velocity of atomized particles of a coating material spayed from a spray gun 30, and controlling the deposition behavior of the atomized particles deposited on an object 50 so that they are substantially the same as in an actual coating operation. Therefore, a coated film having a finished quality substantially the same as one obtained in an actual coating operation can be formed.

The invention claimed is:

1. Film forming equipment comprising:

an object conveyor for holding an object, the object conveyor having a structure providing shifting movement, reciprocating movement thereto, direction of reciprocating movement being different from that of shifting movement, and shifting movement for sequentially conducting partial layer coatings in the direction different from that of the shifting movement and that of the reciprocating movement;

a spray gun conveyor for holding a spray gun that sprays a coating material, the spray gun conveyor having a structure at least providing shifting movement to the spray gun; and a controller connected to the object conveyor, the spray gun, and the spray gun conveyor configured to control operations of the object conveyor, the spray gun, and the spray gun conveyor, wherein, while spraying a coating material from the spray gun, the controller configured to operate the object conveyor so that the object is moved in a shifting direction for sequentially conducting partial layer coatings in a reciprocating direction whereby so that partial layer coatings can be sequentially conducted, and the controller is configured to move a location of the object together with the spray gun in a shifting direction by operating the object conveyor and spray gun conveyor while keeping the relative positions of the object and the spray gun to each other constant.

2. The film forming equipment according to claim 1, wherein the shifting direction in which the object and the spray gun are moved is opposite to the direction in which the shifting direction for sequentially conducting partial layer coatings.

3. The film forming equipment according to claim 2, wherein moving the shifting direction of the object and the spray gun are conducted when a center of spray emitted from the spray gun is positioned substantially in the longitudinal middle of the object in the shifting direction for sequentially conducting partial layer coatings.

4. The film forming equipment according to claim 1, wherein the controller operates the spray gun conveyor so that the spray gun is reciprocated in a synchronized manner in the direction opposite to the reciprocating direction of the object.

5. Film forming equipment comprising:

an object conveyor means for holding an object and providing shifting movement, reciprocating movement thereto, direction of reciprocating movement being different from that of shifting movement, and shifting movement for sequentially conducting partial layer coatings in the direction different from that of the shifting movement and that of the reciprocating movement;

a spray gun means for spraying a coating material;

a spray gun conveyor means for holding the spray gun means and at least providing shifting movement to the spray gun means; and a controller means connected to the object conveyor means, the spray gun means, and the spray gun conveyor means; the controller means is configured to control:

spraying of a coating material from the spray gun means, operations of the object conveyor means, the spray gun means, and the spray gun conveyor means, movement of the object conveyor means in a shifting direction for sequentially conducting partial layer coatings and reciprocating direction, whereby partial layer coatings are sequentially conducted, while spraying a coating material from the spray gun means, and location of the object and the spray gun means in a shifting direction and maintaining the relative positions of the object and the spray gun means to each other constant, while controlling operations of the object conveyor means and the spray gun conveyor means.

* * * * *